US006323808B1

(12) United States Patent
Heinrichs et al.

(10) Patent No.: US 6,323,808 B1
(45) Date of Patent: Nov. 27, 2001

(54) DIELECTRIC RESONATOR ANTENNA

(75) Inventors: Frank Heinrichs; Rebekka Porath, both of Aachen (DE); Peter J. Massey, Horley (GB)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/459,630

(22) Filed: Dec. 13, 1999

(30) Foreign Application Priority Data

Dec. 18, 1998 (DE) ..... 198 58 790

(51) Int. Cl.[7] ..... H01Q 1/38

(52) U.S. Cl. ..... 343/700 MS; 343/702; 343/873

(58) Field of Search ..... 343/700 MS, 702, 343/873, 829, 846, 848, 849; 333/21, 221.1, 702, 219.1; H01Q 1/38

(56) References Cited

U.S. PATENT DOCUMENTS 5,940,036 * 8/1999 Oliver et al. ..... 343/700 MS
5,952,972 * 9/1999 Ittipiboon et al. ..... 343/700 MS

FOREIGN PATENT DOCUMENTS

0982799A2 3/2000 (EP) ..... H01Q/9/04
2000232317-A * 8/2000 (JP) ..... H01Q/13/08

OTHER PUBLICATIONS

By Mongia R. K. et al. "Measurement of Radiation Efficiency of Dielectric Resonator Antennas"; IEEE Microwave and Guided Wave; Letters, US, IEEE Inc, New York, BD. 4, Nr. 3, Mar. 1 1004 pp. 80–82.

By Mongia R. K. et al. "Theoretical and Experimental Investigations on Rectangular Dielectric Resonator Antennas" IEEE Transactions on Antennas and Propagation, US, IEEEInc. New York Bd. 45, Nr. 9, Sep. 1, 1997 pp. 1348–1356.

* cited by examiner

*Primary Examiner*—Don Weng
*Assistant Examiner*—Shih-Chao Chen
(74) *Attorney, Agent, or Firm*—Dicran Halajian

(57) ABSTRACT

A dielectric resonator antenna is a cuboid having a first edge, a second edge and a third edge. The first edge is the shortest edge and forms part of a first surface and a second surface of the cuboid. The first surface is for coupling to a transmission line and the second surface is for mounting on a circuit board. The second and third edges have substantially equal lengths. Further, the first and second surfaces are coated with a conducting layer.

8 Claims, 3 Drawing Sheets

DIELECTRIC RESONATOR ANTENNA

FIELD OF THE INVENTION

The invention relates to a dielectric resonator antenna comprising a cuboid of a dielectric material, in which cuboid an electric field configuration of an eigenmode of the dielectric resonator antenna, which eigenmode is particularly generated by external excitation, has at least two non-parallel planes of symmetry.

The invention further relates to a transmitter, a receiver and a mobile radiotelephone that includes a dielectric resonator antenna comprising a cuboid of a dielectric material, in which cuboid an electric field configuration of an eigenmode of the dielectric resonator antenna, which eigenmode is particularly generated by external excitation, has at least two non-parallel planes of symmetry.

BACKGROUND OF THE INVENTION

Dielectric resonator antennas (DRAs) are known as miniaturized antennas of ceramics or another dielectric medium for microwave frequencies. A dielectric resonator whose dielectric medium, which has a relative permittivity of $\in_r >> 1$, is surrounded by air, has a discrete spectrum of eigenfrequencies and eigenmodes due to the electromagnetic limiting conditions on the boundary surfaces of the dielectric medium. These conditions are defined by the special solution of the electromagnetic equations for the dielectric medium with the given limiting conditions on the boundary surfaces. Contrary to a resonator, which has a very high quality when radiation losses are avoided, the radiation of power is the main item in a resonator antenna. Since no conducting structures are used as a radiating element, the skin effect cannot be detrimental. Therefore, such antennas have low-ohmic losses at high frequencies. When materials are used that have a high relative permittivity, a compact, miniaturized structure may be achieved since the dimensions may be reduced for a preselected eigenfrequency (transmission and reception frequency) by increasing $\in_r$. The dimensions of a DRA of a given frequency are substantially inversely proportional to $\sqrt{\in_r}$. An increase of $\in_r$ by a factor of $\alpha$ thus causes a reduction of all the dimensions by the factor $\sqrt{\alpha}$ and thus of the volume by a factor of $\alpha^{3/2}$, while the resonant frequency is kept the same. Furthermore, a material for a DRA is to be suitable for use at high frequencies, have small dielectric losses and temperature stability. This strongly limits the materials that can be used. Suitable materials have $\in_r$ values of typically a maximum of 120. Besides this limitation of the possibility of miniaturization, the radiation properties of a DRA degrade with a rising $\in_r$.

Such a DR antenna 1 in the basic form considered by way of example is represented in FIG. 1. Not only the form of a cuboid, but also other forms are possible such as, for example, cylindrical or spherical geometries. Dielectric resonator antennas are resonant modules that work only in a narrow band around one of their resonant frequencies (eigenfrequencies). The problem of the miniaturization of an antenna is equivalent to the fact of lowering the operating frequency with given antenna dimensions. Therefore, the lowest resonance ($TE^z_{111}$) mode is used. This mode has planes of symmetry in its electromagnetic fields, of which one plane of symmetry of the electric field is referenced plane of symmetry 2. When the antenna is halved in the plane of symmetry 2 and an electrically conducting surface 3 is deposited (for example, a metal coating), the resonant frequency continues to be equal to the resonant frequency of an antenna with the original dimensions. In this manner, a structure is obtained in which the same mode is formed with the same frequency. This is represented in FIG. 2. A further miniaturization can be achieved with this antenna by means of a dielectric medium that has a high relative permittivity $\in_r$. Preferably, a material that has low dielectric losses is selected.

Such a dielectric resonator antenna is described in the article "Dielectric Resonator Antennas—A review and general design relations for resonant frequency and bandwidth", Rajesh K. Mongia and Prakash Barthia, Intern. Journal of Microwave and Millimeter-Wave Computer-aided Engineering, vol. 4, no. 3, 1994, pp. 230–247. The article gives an overview of the modes and the radiation characteristics for various shapes, such as cylindrical, spherical and rectangular DRAs. For different shapes, the possible modes and planes of symmetry are shown (see FIGS. 4, 5, 6 and p. 240, left column, lines 1–21). Particularly a cuboidal dielectric resonator antenna is described in the FIG. 9 and the associated description. By means of a metal surface in the x-z plane, with y=0, or in the y-z plane, with x=0, the original structure may be halved, without modifying the field configuration or other resonance characteristics for the $TE^z_{111}$-mode (p. 244, right column, lines 1–7). The DRA is excited via a microwave lead in that it is inserted into the stray field in the neighborhood of a microwave line (for example, a microstrip line or the end of a coaxial line).

The possibility of reducing the volume is limited to the use of the two planes of symmetry arranged at right angles to each other as outside surfaces. In this manner, the volume of a DRA may be reduced only by the factor of 4 with the same frequency.

SUMMARY OF THE INVENTION

Therefore, it is an object of the invention to provide a dielectric resonator antenna that offers better possibilities of reducing the volume. Furthermore, it is an object of the invention to provide a transmitter, a receiver and a mobile radiotelephone that has better possibilities of reducing the overall volume and of installing components inside a device.

According to the invention, the object is achieved in that the cuboid edge that runs parallel with an intersecting line of the planes of symmetry forms the shortest edge of the cuboid. The planes of symmetry of the electric field configuration of an eigenmode are at right angles to each other and in parallel with a respective outside surface of the cuboid. Therefore, the intersecting line of the planes of symmetry runs parallel with one of the edges of the cuboid. The length of this edge is referenced d and, in a dielectric resonator antenna according to the invention, is clearly smaller than the length of the two other edges of the cuboid. The edge having the length d is thus perpendicular to the electric field of the eigenmode of the antenna. For making a better and particularly flexible reduction of the antenna volume possible, the length of at least one edge is to be reduced. Surprisingly, the edge having the length d appears to allow a clear shortening without a considerable loss of efficiency of the antenna. Both the radiation power and the accuracy of the resonant frequency are maintained.

In a further embodiment of the invention is provided that there is a first plane of symmetry running parallel with a first outside surface in the geometric center of the cuboid, that a second plane of symmetry is perpendicular to the first plane of symmetry and parallel with a second outside surface in the geometric center of the cuboid, that the first and second planes of symmetry are provided for forming each an outside surface of a dielectric resonator antenna, and that an electrically conducting coating is deposited on the outside surfaces formed by the planes of symmetry. When the lowest eigenmode is used as a resonant frequency, the planes of symmetry are found at each respective half edge length in the center of the cuboid. Even with a miniaturization of the antenna, provided that the planes of symmetry with an electrically conducting coating form the outside surfaces, the length d of the edge running parallel with the intersecting line may be highly advantageously reduced so as to reduce the antenna volume. The selection according to the invention of the edge of the cuboid provides that the size of the electrically conducting and coated outside surfaces is reduced, whereas the size of the outside surfaces of the antenna, via which the power is sent or received, is maintained. This leads to a constant high antenna efficiency despite the reduction of the antenna volume.

For an advantageous embodiment of the invention there is provided that a metal coating is deposited on the two outside surfaces, that one metal coating is connected to a printed circuit board, that the printed circuit board contains a line for a send or receive signal and that the line for a send or receive signal is coupled to the antenna via the metal coating and a contact installed on the dielectric resonator antenna.

The object of the invention is furthermore achieved by a transmitter, a receiver and a mobile radiotelephone having such a dielectric resonator antenna, in which antenna the cuboid edge running parallel with an intersecting line of the planes of symmetry is provided for forming the shortest edge of the cuboid.

These and other aspects of the invention are apparent from and will be elucidated with reference to the embodiment(s) described hereinafter.

DETAILED DESCRIPTION OF THE INVENTION

Figure 1:
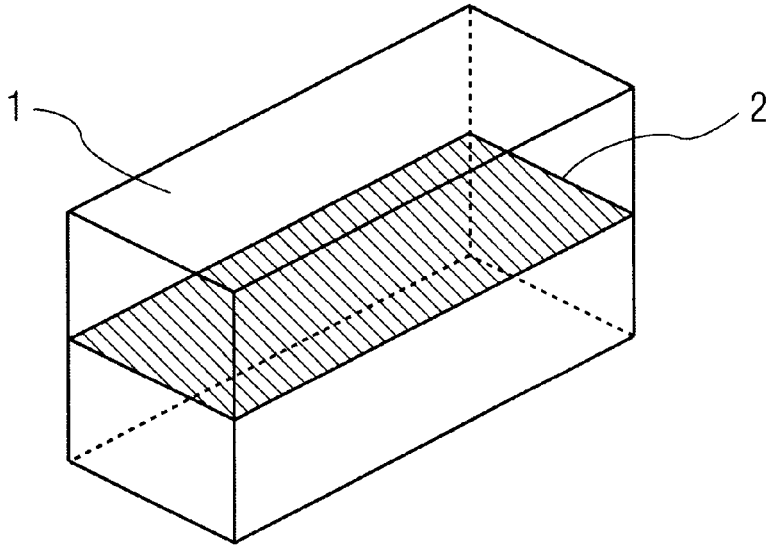
FIG. 1 PRIOR ART
FIG. 1: shows a dielectric resonator antenna.
Figure 2:
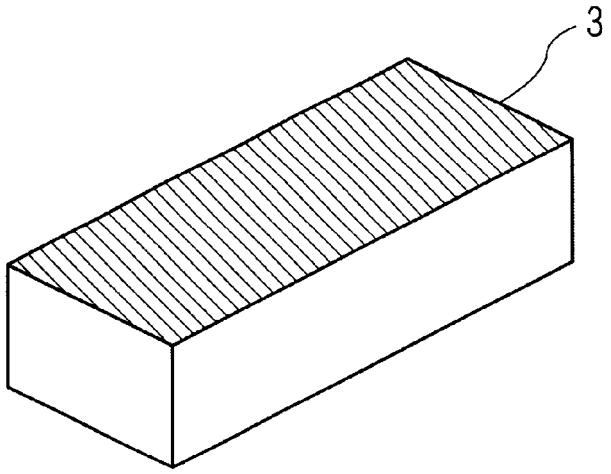
FIG. 2 PRIOR ART
FIG. 2: shows a halved dielectric resonator antenna having an electrically conducting coating in a plane of symmetry.
Figure 3:
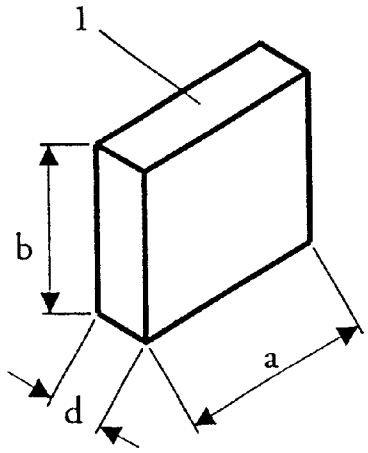
FIG. 3: shows a cuboidal basic form of the dielectric resonator antenna having side lengths a, b and d.

FIG. 3 shows a dielectric resonator antenna DRA 1 in a basic form having rectangular side faces and side lengths a, b and d in the directions x, y and z of a Cartesian co-ordinate system. The DRA 1 has a discrete spectrum of eigenfrequencies, which are determined by the geometric form and the outside dimensions and by the relative permittivity $\in_r$ of the material used. For using the DRA 1 as an antenna for microwave power at a defined frequency, its eigenfrequency is to be in the neighborhood of the defined frequency. In the example of embodiment, the DRA 1 is designed for the center frequency 942.5 MHz of the GSM900 standard as a given frequency. Temperature-stable ceramics, typically having a value of $\in_r$=85, are used as the material. This leads to the dimensions of about a≈b≈30 mm and d≈5.5 mm for the cuboidal DRA 1. Since these dimensions appear to be too large for an integration in mobile communication devices, the size of the DRA 1 as shown in FIGS. 4A and 4B is reduced.

Figure 4A:
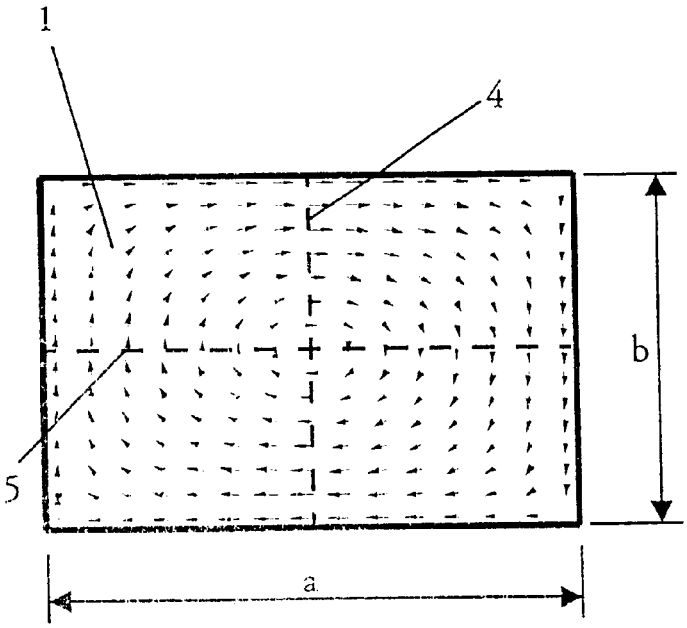
FIG. 4A: shows a field configuration of an electric field of an eigenmode of a cuboidal dielectric resonator antenna in a plane perpendicular to the shortest side length.
Figure 4B:
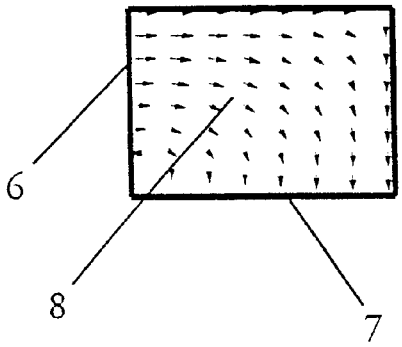
FIG. 4B: shows an antenna reduced in size along the planes of symmetry of the dielectric resonator antenna with the field configuration.

FIG. 4A shows a cross-section through the rectangularly shaped DRA 1 in a plane perpendicular to the shortest side length d. The side lengths a and b lie in the directions of the x and y-axis, respectively. For this purpose, a field configuration of an electric field is drawn that belongs to the eigenmode with the lowest frequency of the DRA 1. This electric field configuration clearly shows at x=a/2 and y=b/2 two planes of symmetry 4 and 5 perpendicular to each other, which are featured by dashed lines in the cross-section. The two planes of symmetry 4 and 5 and the intersecting line are perpendicular to the plane of drawing. FIG. 3 shows that the cuboid edge running parallel with the intersecting line is referenced length d. If the DRA 1 is cut off along one of these planes, and if the cut-off surface is metallized with a coating 6, 7, a structure will be obtained in which the same mode is formed at the same frequency. If this method is used twice, the reduced-size DRA 8 will be obtained as shown in FIG. 4B. By means of the known planes of symmetry 4 and 5, the volume of the DRA 1 may be reduced by a factor of 4 to a/2*b/2*d(x*y*6) at constant frequency. The result of the example of embodiment is the DRA 8 having the dimensions 15*15*5.5 $mm^3$.

As the volume of DRA 1 directly depends on the length d, the DRA 1 may be miniaturized by shortening d. Particularly with the reduced-size DRA 8 having the volume a/2*b/2*d, only the outside surfaces coated by the coatings 6 and 7 are reduced by the shortening. The extension of these surfaces beyond a/2*d or b/2*d depends on the length of the edge d, whereas the outside surfaces a/2*b/2 remain constant. Since particularly the size of the radiating outside surfaces of a DRA 8 is characteristic of the efficiency, and no power can be radiated via the metallized outside surfaces, the radiation efficiency of the DRA 8 is reduced only slightly.

Figure 5:
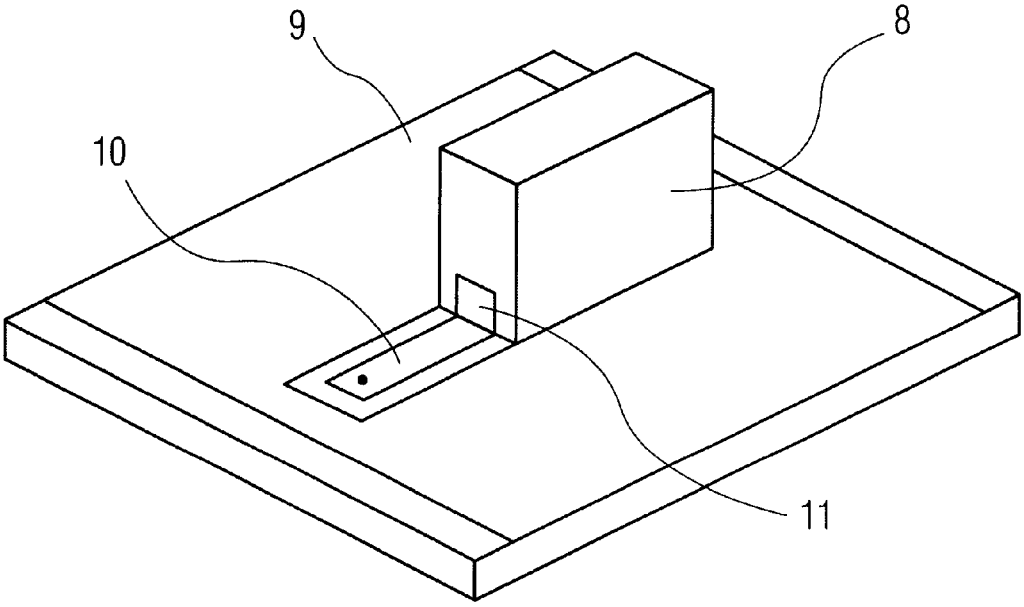
FIG. 5: shows a dielectric resonator antenna mounted on a printed circuit board with a lead.

FIG. 5 represents a dielectric resonator antenna 8 mounted on a printed circuit board 9 with a lead 10. The lead 10 is formed by a microstrip line 10. The DRA 8 is formed by a cuboid of a dielectric material having $\in_r$=81 and the dimensions a=9.7 mm, b=9.7 mm and d=3.55 mm. On a narrow outside surface perpendicular to the printed circuit board 9 the DRA is covered by a metal coating. The printed circuit board 9 consists of a conducting surface on a dielectric coating. In a part recessed from the conducting surface, which part borders on a narrow outside surface without a metal coating of the DRA 8, the microstrip line 10 is deposited. The microstrip line 10 is used for transmitting a transmit or receive signal. For this purpose, an electrical contact 11 is arranged on the narrow outside surface of the DRA 8 bordering on the microstrip line 10, which contact is connected to the microstrip line 10. At the other end of the microstrip line 10 there may be a further contact for connecting a coaxial line. The DRA 8 in this embodiment has a center frequency of 1906.5 MHz and a 3 dB bandwidth of 2.4%.

Figure 6:
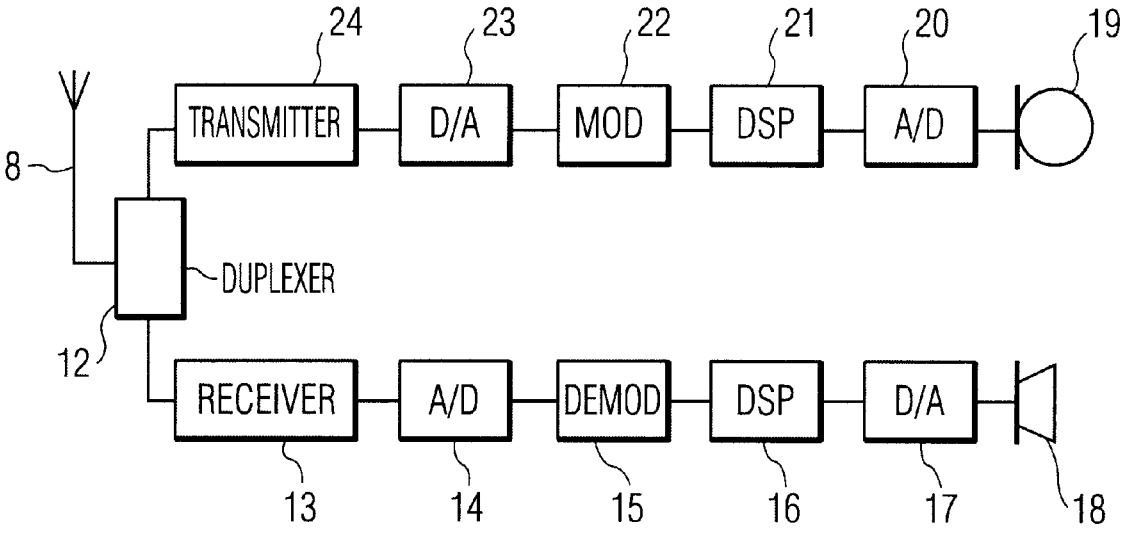
FIG. 6: shows a simplified block diagram of a mobile radiotelephone with a send and receive path and a dielectric resonator antenna.

FIG. 6 shows in a block diagram the function blocks of a send and a receive path of a mobile radiotelephone including a DRA 8 such as, for example, a mobile telephone satisfying the GSM standard. The DRA 8 is coupled to an antenna switch or frequency duplexer 12, which connects in a receive or send mode the receive or send path to the DRA 8. In the receive mode, the analog radio signals arrive at an A/D converter 14 via a receiving circuit 13. The generated digital signals are demodulated in a demodulator 15 and subsequently applied to a digital signal processor (DSP) 16. In the DSP 16 are executed consecutively the functions of equalization, decryption, channel decoding and speech decoding, which are not shown separately. Analog signals delivered via a loudspeaker 18 are generated by a D/A converter 17.

In the send mode, the analog speech signals captured by a microphone 19 are converted in an A/D converter 20 and then applied to a DSP 21. The DSP 21 executes the functions of speech coding, channel coding and encryption which are complementary to the receiving mode, which functions are all executed by a single DSP. The binary coded data words are GMSK modulated in a modulator 22 and then converted into analog radio signals in a D/A converter 23. A transmitter end stage 24, which includes a power amplifier, generates the radio signal to be transmitted via the DRA 8.

The description of the transmitting or receiving path 8, 13, 14, 15, 16, 17, 18 or 8, 19, 20, 21, 22, 23, 24 corresponds to the path of a single transmitter or receiver. The frequency duplexer 12 need not be provided, but transmitting and receiving paths use their own DRA 8 as an antenna. In addition to the use in the field of mobile radio, a use in any other field of radio transmission is conceivable (for example, for cordless telephones according to DECT or CT standards, for radio relay equipment or trunking sets or pagers). The DRA 8 can always be adapted to the transmission frequency.

What is claimed is:

1. A dielectric resonator antenna comprising a cuboid of a dielectric material, wherein in said cuboid an electric field configuration of an eigenmode of the dielectric resonator antenna generated by external excitation has at least two non-parallel planes of symmetry, said cuboid having an edge running parallel with an intersecting line of the planes of symmetry, said edge forming a shortest edge of the cuboid while other edges of said cuboid are substantially equal to each other.

2. The dielectric resonator antenna as claimed in claim 1, wherein a first plane of symmetry runs parallel with a first outside surface in the geometric center of the cuboid, a second plane of symmetry is perpendicular to the first plane of symmetry and parallel with a second outside surface in the geometric center of the cuboid, the first and second planes of symmetry are provided for forming each an outside surface of a dielectric resonator antenna, and an electrically conducting coating is deposited on the outside surfaces formed by the planes of symmetry.

3. A dielectric resonator antenna as claimed in claim 2, wherein:

the two outside surfaces are each covered by a metal coating, one metal coating is connected to a printed circuit board, the printed circuit board contains a line for a transmit or receive signal, and the line for a transmit or receive signal is coupled to the antenna via the metal coating and a contact deposited on the dielectric resonator antenna.

4. A transmitter including a dielectric resonator antenna formed by a cuboid of a dielectric material, wherein in said cuboid an electric field configuration of an eigenmode of the dielectric resonator antenna generated by external excitation has at least two non-parallel planes of symmetry, the cuboid having an edge running parallel with an intersecting line of the planes of symmetry, said edge forming a shortest edge of the cuboid while other edges of said cuboid are substantially equal to each other.

5. A receiver including a dielectric resonator antenna comprising a cuboid of a dielectric material, wherein in said cuboid an electric field configuration of an eigenmode of the dielectric resonator antenna generated by external excitation has at least two non-parallel planes of symmetry, the cuboid having an edge running parallel with an intersecting line of the planes of symmetry, said edge forming a shortest edge of the cuboid while other edges of said cuboid are substantially equal to each other.

6. A mobile radiotelephone including a dielectric resonator antenna comprising a cuboid of a dielectric material, wherein in said cuboid an electric field configuration of an eigenmode of the dielectric resonator antenna generated by external excitation has at least two non-parallel planes of symmetry, the cuboid having an edge running parallel with an intersecting line of the planes of symmetry, said edge forming a shortest edge of the cuboid while other edges of said cuboid are substantially equal to each other.

7. A dielectric resonator antenna comprising a cuboid having a first edge, a second edge and a third edge; wherein said first edge is a shortest edge of said cuboid and forms part of a first surface and a second surface of said cuboid; said first surface being configured for coupling to a transmission line and said second surface being configured for mounting on a circuit board; wherein said second edge and said third edge have substantially equal lengths.

8. The dielectric resonator antenna of claim 7, wherein said first surface and said second surface are entirely coated with a conducting layer.

* * * * *